US005248042A

United States Patent [19]

Kuhmonen

[11] Patent Number: 5,248,042

[45] Date of Patent: Sep. 28, 1993

[54] RESILIENT WIRE-WRAPPED, AND ADJUSTABLY TENSIONED SCREEN DRUM WITH DRUM OVERLOAD-PREVENTING FEEDBACK CONTROL

[75] Inventor: Mauri Kuhmonen, Soini, Finland

[73] Assignees: Ossi Rissanen, Soini, Finland; Vernon F. Chevalier, Locust, N.J.; part interest to each

[21] Appl. No.: 716,932

[22] Filed: Jun. 18, 1991

[51] Int. Cl.[5] ..... B07B 15/00; B07B 1/22; B07B 1/46; B07B 1/58

[52] U.S. Cl. ..... 209/234; 198/524; 198/573; 198/577; 209/238; 209/241; 209/247; 209/288; 209/307; 209/364; 209/390; 209/393; 209/400; 209/406; 209/420; 241/74; 241/79.003

[58] Field of Search ..... 209/234, 238, 241, 242, 209/235, 246, 257, 253, 247, 261, 284, 288, 307, 364, 370, 379, 385, 389, 392, 400, 393, 402, 406, 240, 420, 421, 546, 548, 626, 665, 664; 198/573, 577, 810, 524; 241/74, 79.3

[56] References Cited

U.S. PATENT DOCUMENTS

| | | | |
|---|---|---|---|
| 65,716 | 6/1867 | Alexander | 209/400 |
| 447,162 | 2/1891 | Prescott et al. . | |
| 530,086 | 12/1894 | Butler et al. | 209/400 |
| 1,081,969 | 12/1913 | Ladd et al. . | |
| 1,321,773 | 11/1919 | Ross . | |
| 1,370,620 | 3/1921 | Willson | 209/400 X |
| 1,420,685 | 6/1922 | Burch . | |
| 1,458,299 | 6/1923 | Jacquelin | 209/400 |
| 1,786,131 | 12/1930 | Schulze . | |
| 2,516,963 | 8/1950 | Derbenwick et al. | 146/17 |
| 2,620,064 | 12/1952 | Thys | 209/307 X |
| 2,904,847 | 9/1959 | Burns | 209/238 X |
| 2,983,379 | 5/1961 | Cram | 209/273 |
| 3,942,625 | 3/1976 | Snead | 198/573 X |
| 4,236,999 | 12/1980 | Burgess et al. | 209/250 |
| 4,278,543 | 7/1981 | Maniquis | 210/403 |
| 4,440,635 | 4/1984 | Reiniger | 209/4 |
| 4,587,745 | 5/1986 | Tanner | 34/95 |
| 4,635,860 | 1/1987 | Kruyer | 209/288 X |
| 4,687,105 | 8/1987 | Edholm et al. | 209/546 |
| 4,896,835 | 1/1990 | Fahrenholz | 241/74 |
| 4,933,073 | 6/1990 | Jonkers et al. | 209/284 |

FOREIGN PATENT DOCUMENTS

| | | | |
|---|---|---|---|
| 0038554 | 10/1981 | European Pat. Off. | 209/307 |
| 0272624 | 6/1988 | European Pat. Off. | 209/288 |
| 3105086 | 8/1982 | Fed. Rep. of Germany | 209/307 |
| 3912187 | 10/1989 | Fed. Rep. of Germany | 198/573 |
| 1181288 | 6/1959 | France | 209/392 |

OTHER PUBLICATIONS

Finnish Patent Application No. 891565, no date.

*Primary Examiner*—Donald T. Hajec
*Attorney, Agent, or Firm*—Cushman, Darby & Cushman

[57] ABSTRACT

A mobile screening apparatus includes a horizontal rotary drum preferably fed by underflow from a prescreening device that is reversible endless belt of screening grizzly bars. The belt reverses for expelling oversize material caught between bars. Force needed to turn the drum is monitored, as a way of controlling drum feeding by the prescreening device, for preventing protracted over-filling of the drum. The screening drum includes an outer peripheral cage of longitudinal bars, at least some of which preferably are movably mounted. A set of wires is circumferentially wrapped about the bar cage, with sufficient flexibility to permit the wires to locally elastically flex away from the bars sufficient to pass slightly oversize material and facilitate cleaning of debris lodged in spaces among the bars and wires. Brushes help dislodge lodged debris. Slanted baffles within the cage propel the processing stream of land-clearing material such as mixed dirt, stones and roots that is being screened, towards an outlet end of the drum. Underflow from the screen is conveyed by a slewable conveyor into cone-shaped piles, possibly after fertilizer or other additives are metered into the product. The apparatus can be tended by a single operator, who may use a front-end loader or similar device for dumping raw material onto the prescreening grizzly bars. Preferably, an on-board internal combustion engine powers hydraulic motors which operate the apparatus elements. Engine exhaust can be piped into the drum for heating the material being screened.

34 Claims, 7 Drawing Sheets

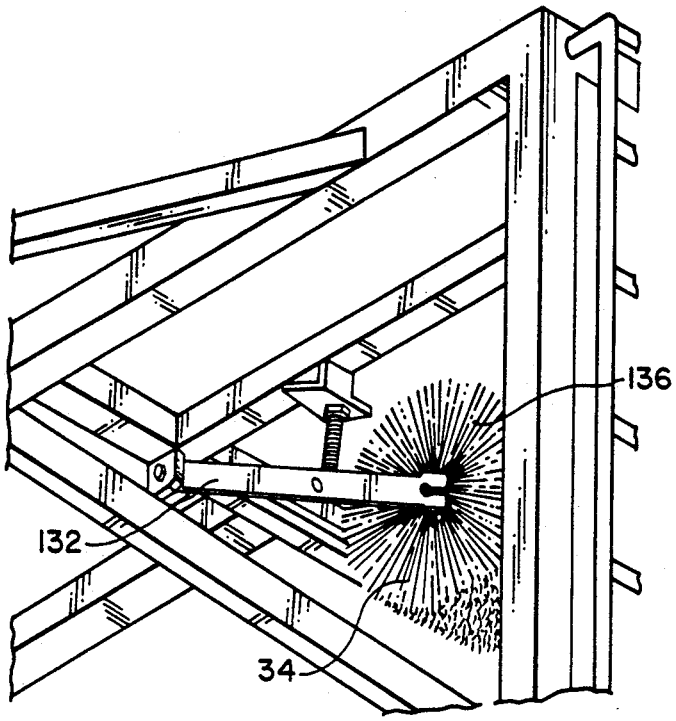
FIG. 11
FIG. 12
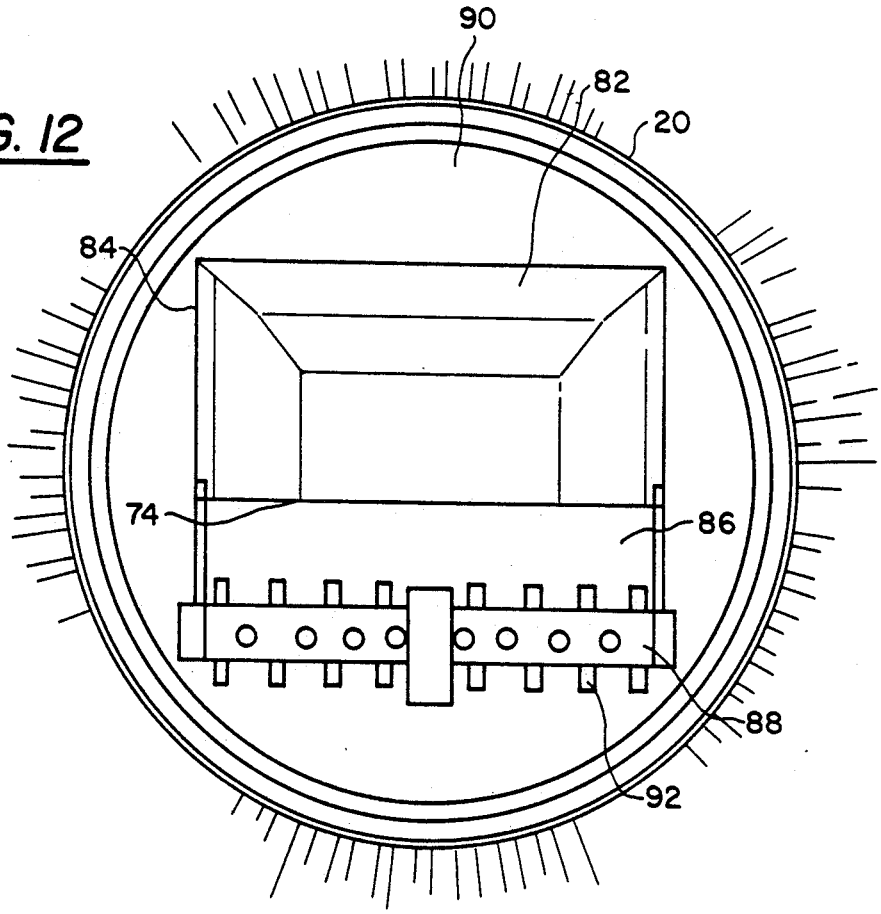

RESILIENT WIRE-WRAPPED, AND ADJUSTABLY TENSIONED SCREEN DRUM WITH DRUM OVERLOAD-PREVENTING FEEDBACK CONTROL

BACKGROUND OF THE INVENTION

The present invention relates to screening apparatus which is useful for processing yard waste, wet mulch, and mixtures of soil, rock, stumps, brush and vegetation, possibly at least partially composted, which has been cleared from raw land that is being subjected to development. The apparatus is also useful in recycling efforts aimed at producing wood fuel, coarse mulch, fine mulch and top soil or horticultural soil from raw, unscreened top soil and/or mixed materials resulting from land-clearing operations. Further, the apparatus is useful for processing garbage, municipal solid waste (both fresh and aged), construction and/or building demolition debris, and the raw product of an automobile shredding operation (for separating so-called fluff from shreds of plastic, glass ferrous and non-ferrous metals and like).

Such devices typically include a prescreening separator, for removing large rocks, stumps, roots and unchipped brush from the processing stream. Overflow is rejected and underflow passes to a tilted or generally horizontal screening drum. Drum overflow is collected as a coarse fraction, drum underflow is collected as a desirable product for use as is, or after further processing. (In the course of some waste-stream processing, neither underflow nor overflow may have a high value, but the separation is desirable and beneficial nevertheless, because the underflow and overflow products may be able to be disposed of to different repositories neither of which economically (or, perhaps legally) could accept the mixed waste stream.)

Frequently, the conventional screening drum has as its radially outer peripheral wall, a perforated metal wall, or a set of longitudinal bars wrapped by a set of circumferential rings. Some prior art drums have a composite peripheral wall, e.g., a foraminous metal screen wrapped by a set of longitudinal bars and/or a set of circumferential rings. In some prior art instances, some of the bars are movably mounted to drum end walls, in order to permit bar shifting for unclogging. Nevertheless, a persistent shortcoming of prior art screening apparatus of the type referred to above, is excessive clogging. As a result, the apparatus must be tended by too many operators, limiting its chances for profitable operation. Clogging causes excessive downtime for performance of unclogging operations and repairs (when jams cause parts to break). Other typical shortcomings of conventional screening apparatus of this type include lack or difficulty of portability, inability to regulate feeding so that the apparatus operates at full capacity without overloading, clogging of prescreening devices, and inability to operate on wet and/or partially frozen material.

SUMMARY OF THE INVENTION

A mobile screening apparatus includes a horizontal rotary drum preferably fed by underflow from a prescreening device that is reversible endless belt of screening grizzly bars. The belt reverses for expelling oversize material caught between bars. The screening drum includes an outer peripheral cage of longitudinal bars, at least some of which preferably are movably mounted. A set of wires is circumferentially wrapped about the bar cage, with sufficient flexibility to permit the wires to locally elastically flex away from the bars sufficient to pass slightly oversize material and facilitate cleaning of debris lodged in spaces among the bars and wires. Brushes help dislodge lodged debris. Slanted baffles within the cage propel the processing stream of land-clearing material such as mixed dirt, stones and roots that is being screened, towards an outlet end of the drum. Underflow from the screen is conveyed by a slewable conveyor into cone-shaped piles, possibly after fertilizer o other additives are metered into the product. The apparatus can be tended by a single operator, who may use a front-end loader or similar device for dumping raw material onto the prescreening grizzly bars. Preferably, an on-board internal combustion engine powers hydraulic motors which operate the apparatus elements. Engine exhaust can be piped into the drum for heating the material being screened. The hydraulic system includes a pressure sensor for indicating resistance to turning of the drum, and a control system for temporarily diminishing delivery of material to the drum for screening at times when increased resistance to turning of the drum indicates that the drum is already loaded with an excess of material.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWINGS

FIG. 11 is a fragmentary top plan view showing mounting of the rotary brushes on arms pivoted to the frame of the chassis;

FIG. 12 is a perspective view from within the drum looking towards the inlet end of the drum;

DETAILED DESCRIPTION

Figure 1:
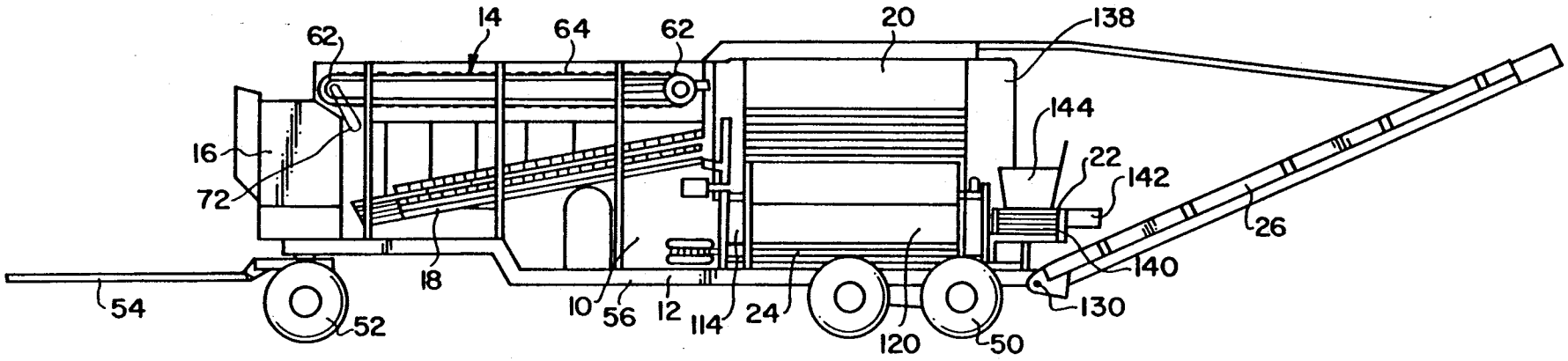
FIG. 1 is a left side elevation view of a screening apparatus embodying principles of the present invention, with most of the body shell removed for exposing structural features otherwise enclosed and hidden thereby.
Figure 2:
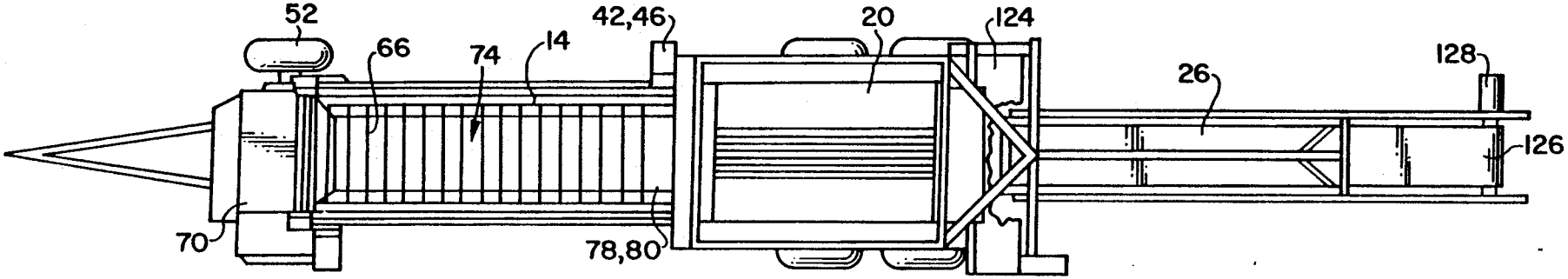
FIG. 2 is a top plan view thereof.
Figure 3:
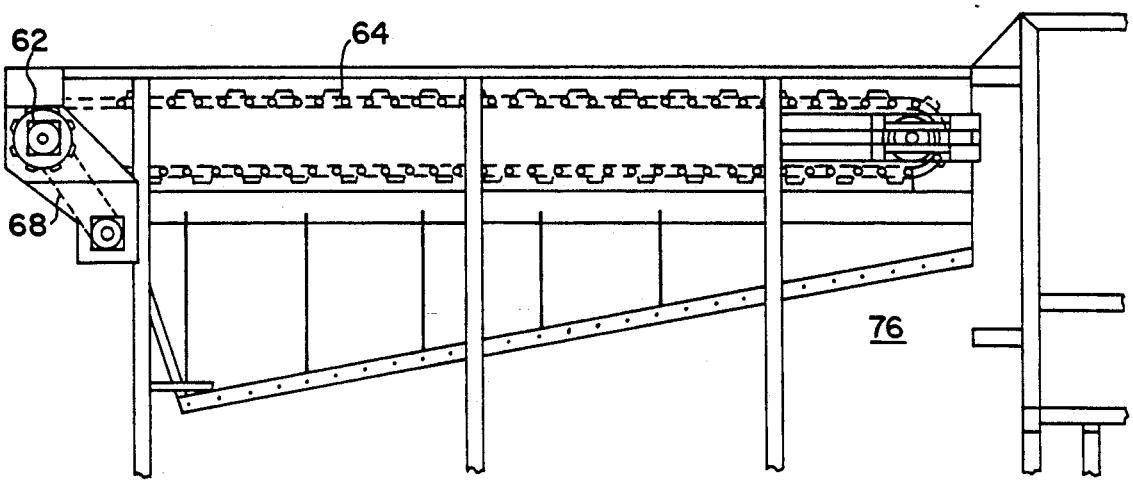
FIG. 3 is a larger scale left side elevation view of the prescreening device thereof.
Figure 4:
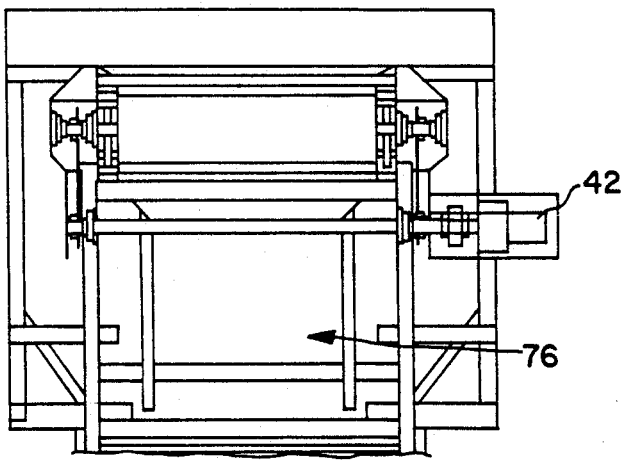
FIG. 4 is a left end elevation view thereof.
Figure 5:
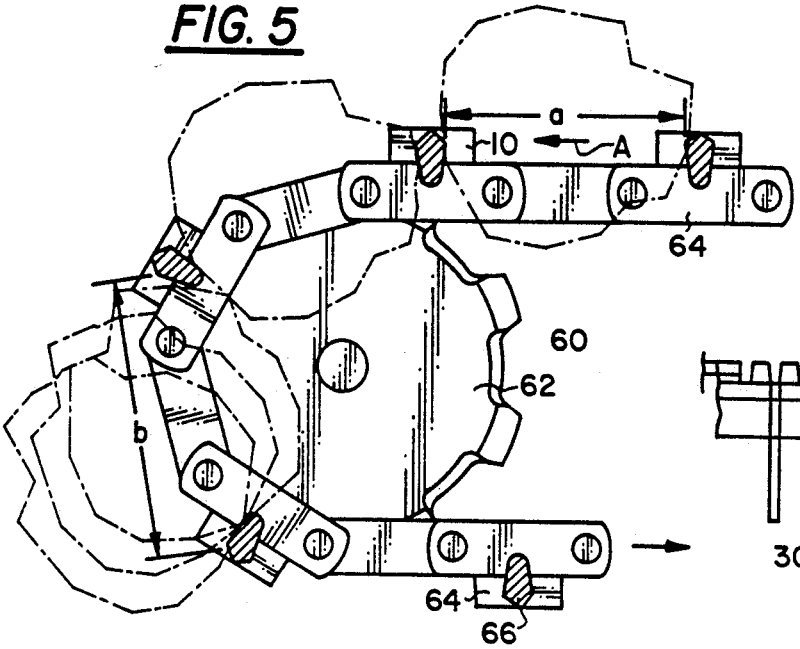
FIG. 5 is a larger scale fragmentary left side elevation view thereof, showing progressive stages in the rejection thereby of a chunk of massively oversize material therefrom.
Figure 7:
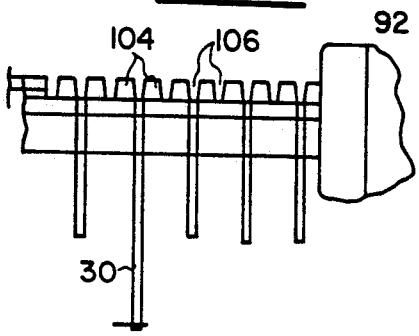
FIG. 7 is a larger scale fragmentary side elevational view of a portion of the outer peripheral wall of the drum.
Figure 8:
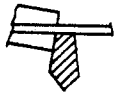
FIG. 8 is a fragmentary transverse sectional view on line 8—8 of FIG. 7.
Figure 6:
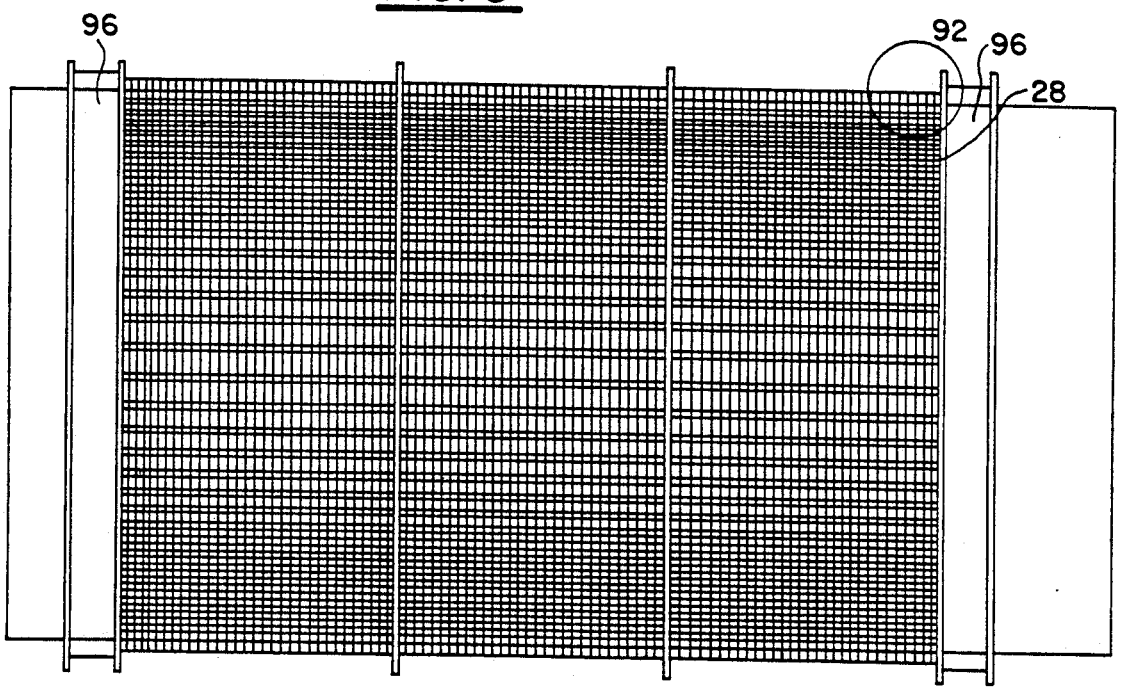
FIG. 6 is a side elevation view of the drum of the screening apparatus.
Figure 9:
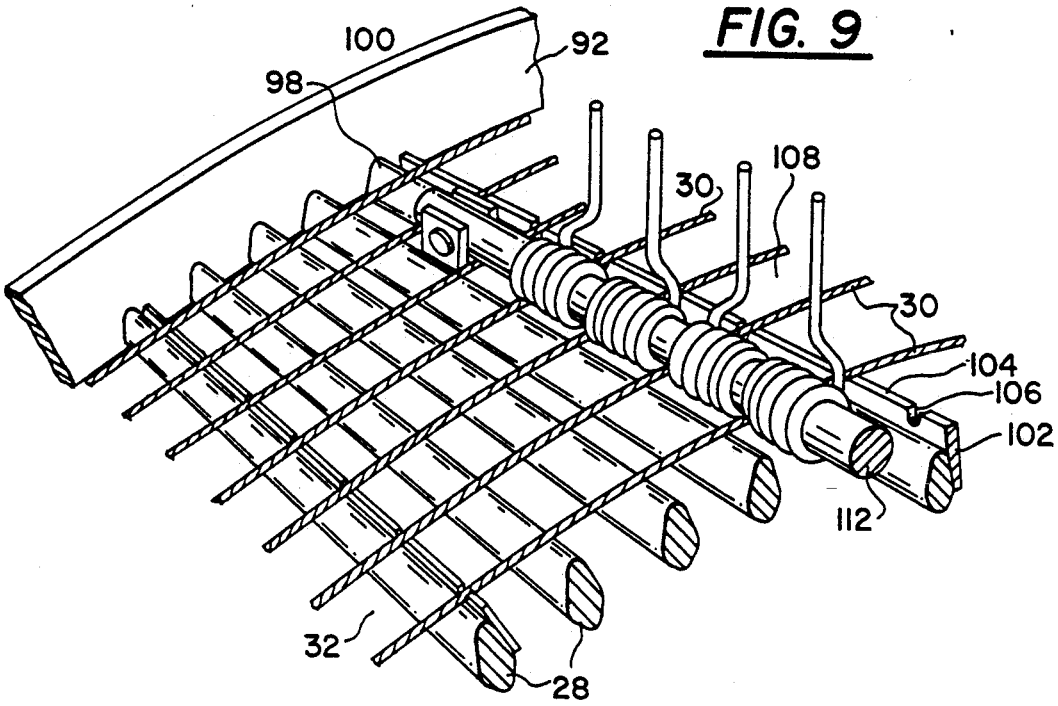
FIG. 9 is a fragmentary perspective view of the drum showing arrangement of wire cables in grooves between teeth of comb mounted to bar, and mounting of scratcher device on outside of outer peripheral wall of drum.
Figure 10:
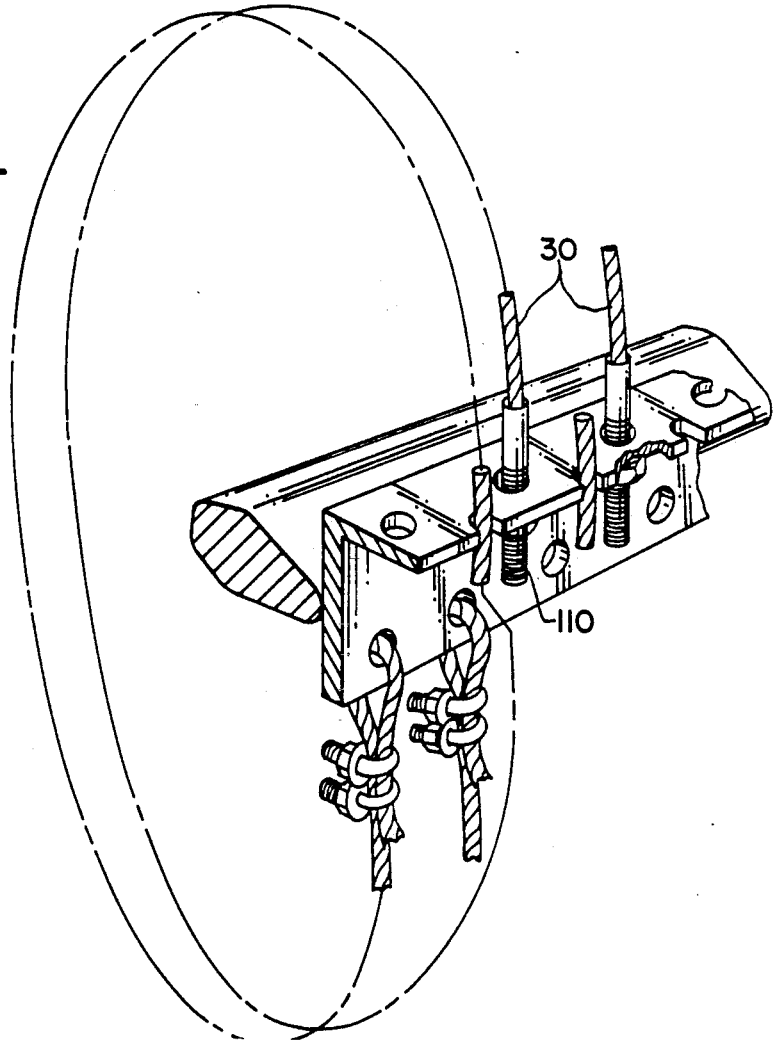
FIG. 10 is a fragmentary perspective view of the drum showing turnbuckles tensioning between doubled-over loops and adjacent two ends of each two-turn multiple strand cable circumferentially wound on the bar cage of the drum.
Figure 13A:
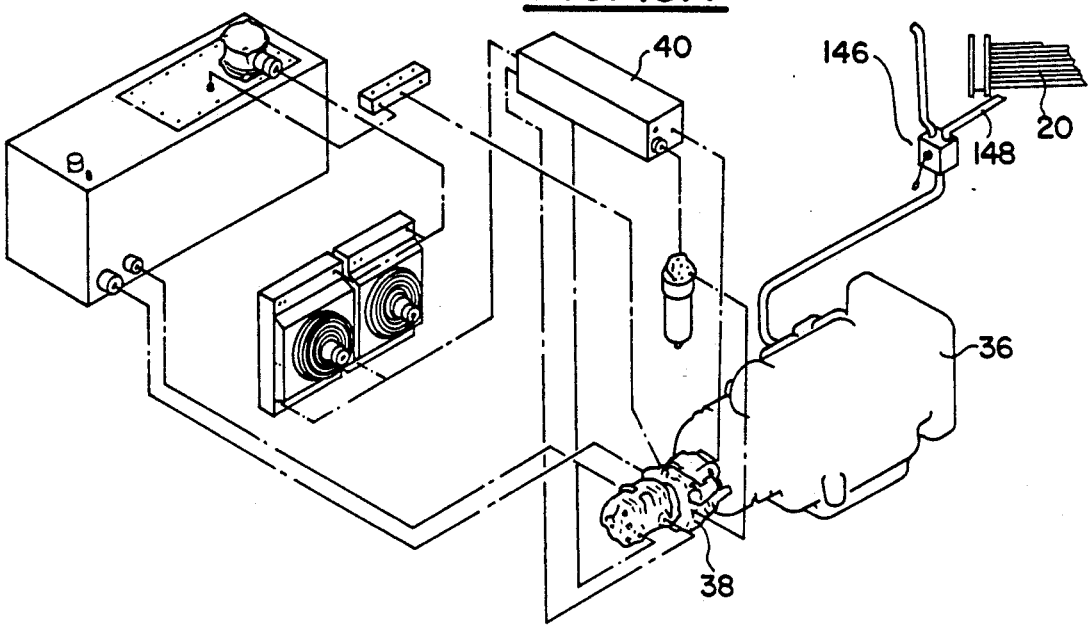
FIG. 13A and B are a schematic layout diagram of the hydraulic system of the apparatus, also illustrating the internal combustion engine for driving the pump means thereof and illustrating, on a small scale, the means for diverting hot exhaust gases from the engine into the screening drum.
Figure 13B:
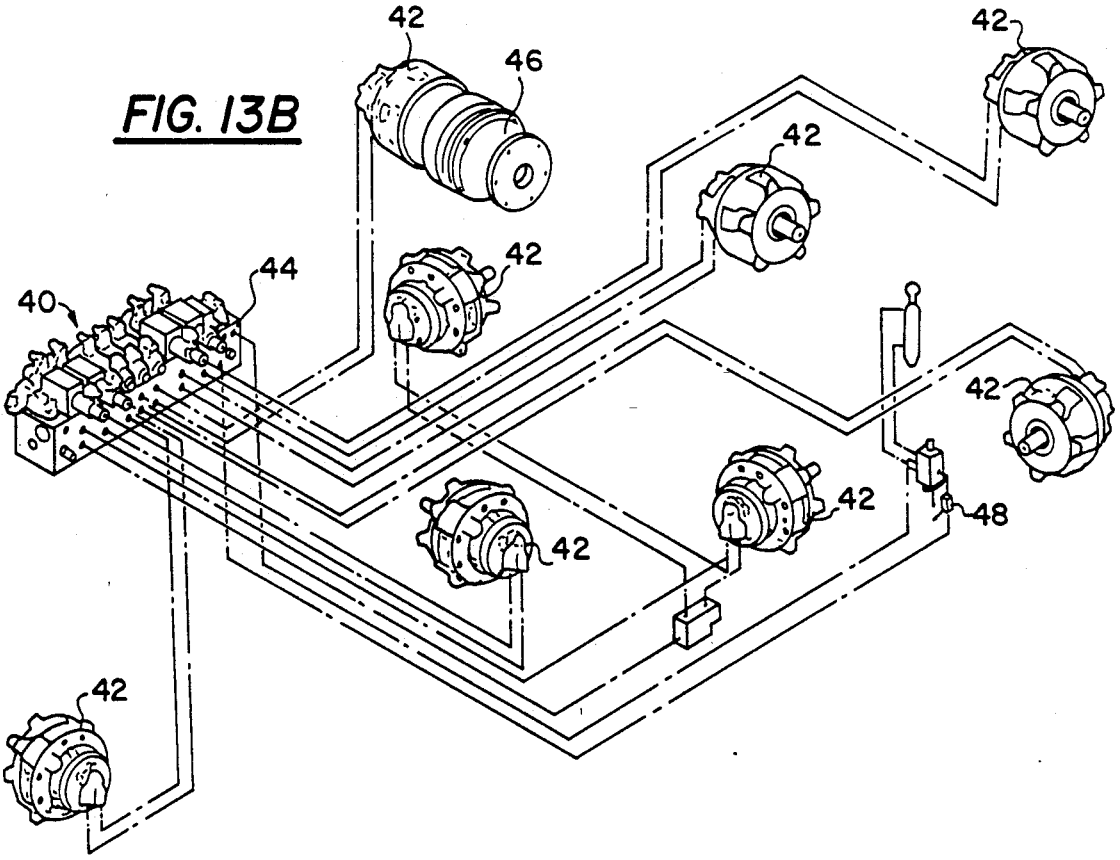
Figure 14:
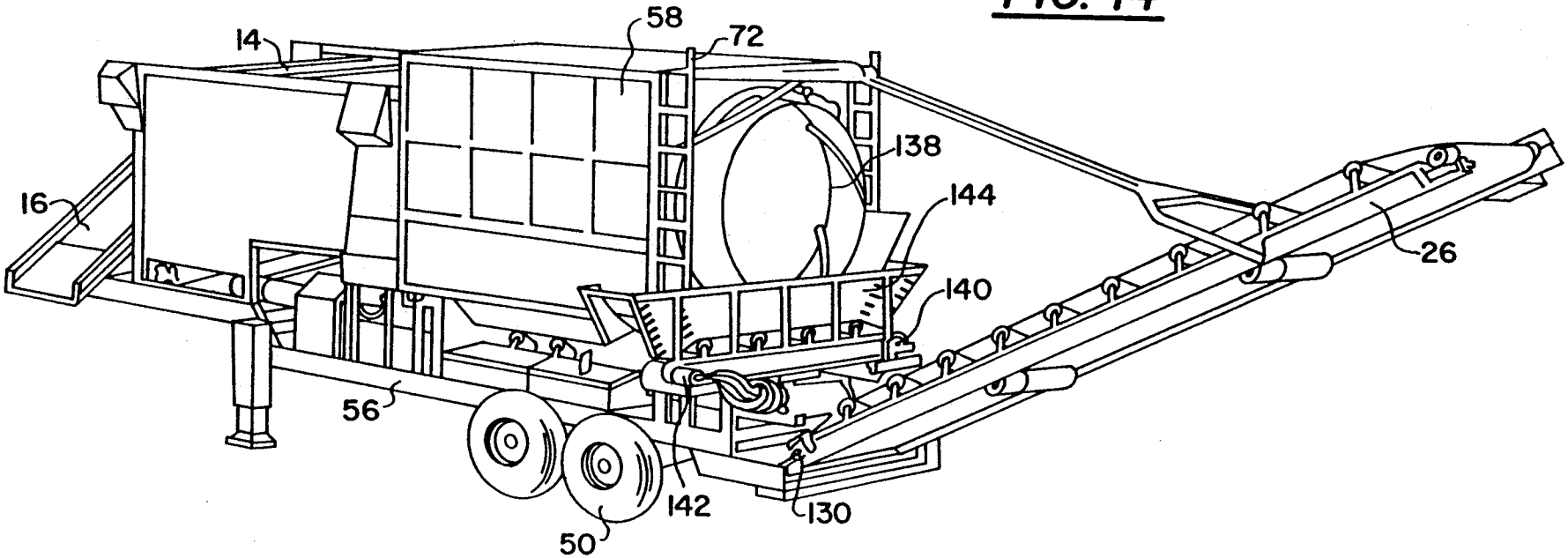
FIG. 14 is a pictorial overall perspective view of the apparatus.

In general, the screening apparatus 10 includes a wheeled chassis 12 on which is provided a prescreening device 14 which diverts overflow to a chute 16 and underflow to a (preferably reversible) conveyor 18 feeding into the interior of a horizontal rotary drum 20. Overflow from the drum is diverted by a transverse conveyor 22. Underflow from the drum collects on a longitudinal conveyor 24 which feeds an inclined discharge conveyor 26 that is pivotable about a vertical axis at its inlet end, so that a plurality of conical piles of underflow product can be built. The prescreening device 14 comprises a reversible endless grizzly bar belt, i.e., it is a scalper. Raw material to be screened is dumped, e.g., using a front-end loader (not shown), onto the device 14. The drum 20 comprises an outer peripheral cage of longitudinal bars 28 circumferentially wrapped by resilient steel wire cables 30 so as to define a pattern of openings 32. In use, prescreened raw material, turning in the drum, falls through onto the conveyor 24 if clearly undersized, and is propelled out of the downstream end of the drum and onto the transverse conveyor 22 if clearly oversized. Within the drum, some material that is particularly dense separates from the drum inner periphery when being uplifted and rains as a hail of stones onto lower sites within the drum, causing impacts and vibrations that temporarily resiliently permit the wire braid hoops to locally move away from the cage of bars. This permits borderline material to pass through the bar cage to underflow, and locally unclogs the bar-cable outer peripheral wall of the drum of oversized debris which has become temporarily lodged in openings among the bars and wire cables of the outer peripheral wall of the drum. Clearing is further effected by rotary brushes 34 which sweep into the openings 32. The apparatus 10 preferably carries onboard power in the form of an internal combustion engine 36 which drives pump means 38 for an hydraulic system 40 having respective hydraulic motors 42 which are drivingly connected with the drum, conveyors and grizzly. Feedback control means 44 provided for the grizzly reverse the direction of movement of the grizzly bars when it is sensed, due to resistance to operation of the grizzly, that an oversized chunk of material has gotten caught between its bars. (Alternatively, or in addition, reversing could be provided by the human operator, e.g., using a radio-controlled switch remotely controlled from his or her operating location, e.g., in the cab of his or her front-end loader.) Similarly, feedback control mean 46 temporarily stop the feeding conveyor 18 when resistance to turning of the drum using the drum-powering hydraulic motor 42 indicates that the drum is temporarily overloaded. Upon resistance to turning dropping below a selected threshold level, the feeding conveyor 18 resumes operation. The human operator who is driving the front end loader, upon seeing the conveyor 18 stop can temporarily stop or slow down his or her loading of raw material onto the grizzly. An optionally used feeder 48 can be operated to meter fertilizer, lime, a neutralizing agent or the like into the underflow product.

Various features of the apparatus 10 will now be described in further detail.

The screening apparatus 10 of the present invention is an improvement upon the screening apparatus which is disclosed in Finnish patent application No. 891565, filed Oct. 8, 1990 (no U.S. counterpart).

The chassis 12 is supported on the ground by rear wheels 50 and a slewable front wheel assembly 52 having a tow bar 54 by means of which the apparatus 10 may be moved from one site to another. Alternatively, a conventional fifth wheel hook-up can be provided in place of 52, 54.

On the chassis 12 is provided a framework 56 which mounts the various apparatus elements, and to which also are mounted elements of a sheet metal body or shell 58 which, at least partially, encloses the apparatus elements.

Provided generally horizontally at an elevated level on the front half of the chassis 12 is a prescreening device 14, which could also be called a grizzly or a scalper.

The purpose of the prescreening device 14 is to immediately shunt aside from the incoming stream of material that is to be processed by the device, such fraction of the incoming material that is grossly oversized, in order to prevent this fraction from slowing down the effective processing by the drum 20.

In situations where no significant amounts of grossly oversized material is included in the stream of material to be processed, the prescreening device 14 could be omitted from an apparatus 10, without departing from the principles of the present invention.

In the preferred embodiment 10, the prescreening device 10 comprises two axially spaced, transversally extending shafts 60, carrying left and right sprockets 62, about which are entrained left and right endless chains 64, in driving relation thereto. A series of square-sectioned steel bars 66 is mounted at opposite ends of each bar to the respective chains 64, so that the bars extend transversally of the apparatus 10, with substantial spacing between neighboring bars longitudinally of the apparatus 10.

As an example, each bar 66 is 66 mm high by 31 mm wide and 130 cm long, and the spacing between adjacent bars on the upper carrying run and lower return run of the bar conveyor 64, 66 is 30 cm. As the bars turn around the sheaves 62 at each end of the conveyor 64, 66, the spacing and spatial relationship between neighboring bars changes from that pertaining on the horizontal runs. In the example, the effective diameter of each sheave 62 is 30 cm.

The conveyor 64, 66 is reversibly driven by a respective hydraulic motor 42, which is shown drivingly connected to a sheave 62 by an endless drive belt 68. This hydraulic motor 42 is reversibly drivable. Normally, the upper run advances towards the front of the apparatus 10 (away from the drum 20), so that raw material that is loaded onto the upper run tends to be conveyed forwards. As this is happening, the majority of the material falls between the bars of both runs and lands on the feeding conveyor 18, but the grossly oversized material is conveyed forwards on the upper carrying run, until, as the bars 66, on which it is resting, begin to turn the forward sheave, most of this material tumbles off the conveyor 64, 66, and drops down onto the inclined floor 70 of the chute 72, and thence out onto the ground in a left-side or right-side prescreening overflow pile. The operator of the apparatus typically will periodically dig into these piles and take the material therein for further processing (e.g., if it is stumps and stones) to a separator (not shown), and then, variously to a chipper and a crusher, in order respectively to produce wood chips and crushed stone.

However, if a stump, root, rock or the like catches between bars, and does not tumble from the prescreening conveyor, the material will be conveyed against a plate of the body of the apparatus 10, causing the pressure to rise in the hydraulic line to the respective motor 42. This rise in pressure is sensed by the pressure sensor of a control means 44, which reverses the running direction of the respective motor 42, and therefore, of the prescreening conveyor 64, 66.

By preference, the distance between the sheaves 66 is 4 meters, and the lineal speed of the carrying run is about ten meters per minute. The control means 44 is preferably set to reverse again after traveling 1 meter. After five reversal cycles, if the blockage remains, preferably the control means 44 stops the respective motor 42, and sends an audible and/or visual signal to the operator, so that the operator can manually clear the blockage. (In order to facilitate this operation and other maintenance, the body of the apparatus 10 is conveniently provided with various steps and ladders 72.)

As mentioned above, the underflow of the prescreening device falls onto a longitudinally extending feeding conveyor 18. This conveyor 18 preferably is a belt conveyor having a belt 74 with a rearwardly inclined, upwardly facing carrying run 76. The belt 74 is entrained about rolls 78, one of which is driven via a drive belt 80 from a respective hydraulic motor 42 having an associated control means 46.

The upper, rearmost trailing end of the conveyor 18 is journalled on a fixed portal wall 82 for the drum 20. The size of the aperture 84 through the portal wall 82 is preferably 1 meter by 0.6 meter, of which the trailing end of the conveyor 18 occupies the lower approximately 26 cm.

Journalled at 86 for rotation on the inside of the portal wall 82 below the trailing end of the conveyor 18 is a toothed steel roll 88 which is driven in conjunction with the conveyor 18 in a direction to dislodge from the belt 74 raw material which has become stuck thereon and is not otherwise tumbling free into the inner cavity space 90 of the drum 20.

The lineal speed of the carrying run of the feeding conveyor 18 typically is 5 meters per minute. The roll 88 typically is 10.5 cm in diameter, exclusive of the teeth 92, which typically protrude 5 cm from the roll. The roll 88 typically is rotated at 280 rpm.

The control means 46 operated to stop the feeding conveyor 18 temporarily, upon it being sensed in the hydraulic system 40 that there is excess pressure on the respective drive motor 42 for rotating the drum 20, due to the fact that the drum 20 already has too much or too heavy a mass of material being screened within its inner cavity space 90.

The drum 20 comprises a generally cylindrical cage-like body having head rings 92 at its opposite ends, and one or more intermediate rings 94. At least some of the rings 92, 94 preferably provide radially outwardly facing running surfaces 96.

An outer peripheral cage of angularly regularly spaced longitudinal bars 28 extends between respective sockets 98 in the rings 92 and through corresponding slots 100 in the intermediate rings 94. In this example, there are 128 bars 28, they are made of steel (as are the rings 92, 94), and every third one is loosely mounted to permit some rocking relative to its neighbors, e.g., as disclosed in the abandoned Neimi, U.S. patent application Ser. No. 07/486,608, filed Feb. 28, 1990. The others are fixed in place, e.g., by welding. The transverse cross-sectional profile of each bar 28 is preferably rounded-corner rectangular, approximately 16 mm by 32 mm, arranged With its narrowest dimension extending circumferentially of the drum. The outer diameter of the cage provided by the bars 28 is about 2 meters, and the drum is about 3 meters long. The space between adjacent bars 28 is about 3.2 cm.

Along one side of certain ones of the bars 28, e.g., every sixth bar, is welded a radially outwardly directed steel plate comb 102. The teeth 104 of the combs 102 protrude radially outwards about 2 mm beyond the outer edges of the respective bars 28 and define between them grooves 106 for receiving and maintaining in desirably spaced positions, the individual circumferential windings of respective steel wire cables 30. By preference, in the example given, there are 81 wire rope cables 30, each 4 to 6 mm in diameter, each turning twice about the drum, with about 1 cm between adjacent cable turns. (Thicker cables would make the holes, openings or spaces 108 between the bars and cable turns too small, and thinner cables would stretch too much and wear out and break too frequently.)

Each cable 30 is preferably strapped onto the bar cage of the drum, by means of being doubled-over in half so as to provide a loop, and two juxtaposed opposite ends. The loop, and opposite ends are attached, e.g., by cable clamps, to opposite ends of a respective combined connector and adjustable tensioner 110, one for each cable 30. Accordingly, the cables 30 may be individually cut away and/or replaced should they prematurely break, and they may be individually tightened using the combined connectors and adjustable tensioners 110. The tightness of each cable turn is such that it can be locally manually pulled radially out away from the bar cage no more than about 3 to 5 cm. The cables 30 form on the bar cage of the drum 20 what is, in effect, a cylindrical "trampoline" to be bounded upon by material being screened, and then to rebound back into place. This somewhat elastic vibration of the cables, in effect, temporarily locally increases the sizes of the holes 108, allowing borderline too-large chunks of material being screened to escape into the underflow, and allowing chunks of material which have become lodged recently or some while ago, to become freed.

The cable stock used to make the cables 30 may be the same type as is conventionally used for providing steel-twisted wire, diameter 4–6 mm.

Another measure of the preferred degree of tightness of the cables 30, is that they can be moved by fingers 2–3 mm in horizontal direction.

The drum 20 may further be provided with outer bars 112 extending longitudinally between the end and intermediate rings, and on which are mounted radially outwardly directed spring tines such as are conventionally used on earth-tillers, the purpose of which is to scratch loose dirt which may otherwise cling to and build up on internal surfaces of the shell or body on the frame of the chassis.

The drum 20 preferably is supported and driven on the chassis 12, by resting in a cradle formed by left and right sets of lower, upwardly presented rubber or metal tired wheels 114, journalled on the chassis for rotation about respective horizontal, longitudinally extending axes. The wheels have radially outer tread surfaces disposed in supporting, driving engagement with the running surfaces 96 on the rings 92 and/or 94. At least one and preferably a plurality of the wheels 114 are driven by drive means 116 from one or more respective hydraulic motors 42. Preferably, the wheels 114 reversibly turn the drum 20, and at a variable speed, typically in the range of 0 to 20 rpm.

Within the cavity space of the drum 20, a plurality of spiral fin-like flanges 118 are welded onto fixed ones of the longitudinal bars of the drum cage so as to act as angular shifters, soil movers, preferably more prevalent near the inlet end than near the outlet end of the drum, and serving, in use, to tend to plow material being sifted in the drum, towards and, thence, out of the outlet end of the drum. Incoming material tends also to force material already in the drum to move longitudinally towards the outlet.

As the drum rotates, the speed is generally not sufficient to keep all of the material centrifugally pinned against the outer peripheral wall provided by the longitudinal bars 28 and circumferential cables 30. Rather, as the material is conveyed upwards on the wall, to greater or lesser proximity to top dead center, gravity tears all or much of it away and it rains down in a hail of stones and other lumps, tending to break up friable material with which it collides, and tending to bound trampoline-like on the wires 30 near the bottom dead center of the drum. Accordingly, more and more material falls through the drum openings 108 near bottom dead water, and onto the upper horizontal run 120 of the longitudinal conveyor 24. The conveyor 24 preferably is a belt-type conveyor entrained about rolls 122 and reversibly driven by drive means 124 from a respective hydraulic motor 42. The lineal speed of the carrying run 120 of the conveyor 24 preferably is about 120 meters per minute. The carrying run 120 extends under all of the length of the drum 20, and sufficiently beyond the outlet end of the drum 20 as to be able to dump its own contents onto the forward end of a rearwardly inclined discharge conveyor 26.

The conveyor 26, also preferably a belt-type conveyor, entrained about rolls 126 and driven by drive means 128 from a respective hydraulic motor 42, is pivotally mounted to the chassis 12 at 130 for slewing (pivoting about a vertical axis near its inlet end, so that its outlet end can swing in an arc. Thus, the discharge conveyor can build several cone-shaped piles with underflow material screened by the drum 20, or load that material into a succession of trucks parked under its outlet end. The carrying run of the conveyor 26 preferably is about six meters long.

One or more rotary brushes 34 preferably journalled on arms 132 are swingably mounted on the shell on the chassis, i.e., along upper left and right corners of shell portions housing the drum 20 so as to run in peripherally driven engagement with the outer peripheral wall of the drum, i.e., with the cage of longitudinal bars and circumferential wires. The weight or pressure on the brushes is sufficient to cause their radiating bristles (preferably made of nylon projecting from a steel core and similar to those used on street sweepers) to somewhat resiliently poke into the openings 108, thereby tending to dislodge radially inwards lumps of material, stones or the like which are clogging the openings 108. The brushes 34 are as long as the drum and respectively engage it at sites far removed from where the stones are flung and bound trampoline-like against the peripheral wall of the drum from within the drum.

The brush bristles 136 preferably are 2.4 by 3.8 mm in transverse cross-sectional measurement, and the brushes are about 52 cm in diameter. The brushes preferably can be pivoted partly or fully out of the way by rotating the arms 132 on which they are mounted, so they will not be excessively worn when they are not needed.

Overflow from the drum 20 falling out of the outlet end 138 lands on the upwardly presented carrying run of the transverse conveyor 22 which conveys it to the side, e.g., into a pile to be separately dealt with from time to time by the operator. The conveyor 22 preferably is a belt-type conveyor, entrained about rolls 140, driven via driving means 142 from a respective hydraulic motor 42, typically at a lineal carrying run speed of 200 meters per minute.

The conveyor 22, like all of the conveyors on the apparatus 10 is flanked by plate means, such as the plate 144, for preventing material being conveyed thereon from falling off at its side or sides, as needed.

By preference, the hot exhaust gas from the internal combustion engine 36 that powers the hydraulic system 40 may be selectively vented externally at 146, or piped back into the drum via the pipe 148. The latter path is useful in cold weather, e.g., when the temperature is down to as low as minus 10° C., for warming frozen lumps among the material being screened, thus permitting it to be more easily pulverized and successfully screened, despite the cold weather.

The apparatus 10 is shown further provided with optional hopper means 150 mounted on the chassis 12 so as to have outlets 152 located directly over the carrying run of the discharge conveyor 26. Auger means 154 located in the outlets 152 are selectively driven via respective drive means 156 from a respective hydraulic motor 42, for metering onto the underflow material predetermined amounts of one or more additives such as fertilizer, lime, pearlite, neutralizing solution or the like.

A typical engine 36 for the apparatus is a 6-cylinder diesel, about 108 kwh.

It should now be apparent that the screening apparatus as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A screening apparatus, comprising:

a screening drum including a radially outer peripheral wall provided by a circumferentially extending series of longitudinally extending bars spaced from one another circumferentially of said peripheral wall so as to define slots between respective adjacent ones of said bars; at least two axially spaced support rings; said bars being mounted to said support rings to provide a cage structure; and a plurality of resilient wire means wrapped circumferentially about said peripheral wall; said wire means being provided as a series of longitudinally spaced turns, defining slots between respective adjacent ones of said turns, superimposed upon said slots between said bars and thereby cooperatively defining with said bars screening openings through said peripheral wall; and means adjustably tensioning said wire means onto said cage structure such as to permit lumps of material while being screened within said drum, when flung through said slots between said bars so as to impact a turn of said wire means, can cause said turn to elastically flex outwardly from said cage sufficiently to temporarily locally increase the effective size of some of said openings, for thereby freeing material clogged into such openings and temporarily permitting passage through such openings of lumps of material which are normally slightly too large to pass therethrough; inlet opening means at one end of said drum for introducing into an internal cavity bounded by said peripheral wall material to be screened; and outlet opening means at an opposite end of said drum for evacuating an overflow fraction of said material from said drum;

a base;

means for supporting said screening drum so as to extend generally horizontally on said base; and means for rotating said drum relative to said base about the longitudinal axis of said drum.

2. The screening apparatus of claim 1, further comprising:

a feeding conveyor supported on said base and having a carrying run with an outlet end arranged to deliver to said internal cavity of said drum through said inlet opening means a stream of material which is to be screened; and means for driving said feeding conveyor.

3. The screening apparatus of claim 2, further comprising:

control means operatively connected with said means for rotating said drum and with said means for driving said feeding conveyor, for sensing resistance to turning of said drum and temporarily diminishing delivery to said internal cavity of said drum, of material to be screened, at times when resistance to turning of said drum indicates said drum is already loaded with an excess of material to be screened.

4. The screening apparatus of claim 3, wherein:

said means for rotating said drum includes an hydraulic motor incorporated in an hydraulic system and said control means includes means for sensing pressure in said hydraulic system as an indication of resistance to turning of said hydraulic motor.

5. The screening apparatus of claim 2, further comprising:

a prescreening device supported on said base in an overlying relationship to said feeding conveyor for passing an underflow of material thereto; said prescreening device including means for rejecting as overflow, material loaded thereon which is grossly too large to pass through said screening openings of said drum.

6. The screening apparatus of claim 5, wherein:

said means for rejecting as overflow comprises an endless, grizzly bar conveyor, and means for operating said grizzly bar conveyor which includes means for automatically sensing resistance to advancing of said grizzly bar conveyor and temporarily reversing direction of an upper carrying run of said grizzly bar conveyor at times when resistance to advancing of said grizzly bar conveyor indicates a piece of material has become lodged between bars thereof.

7. The screening apparatus of claim 6, wherein:

said grizzly bar conveyor includes two longitudinally spaced, transversally extending sprocket means; left and right endless chains entrained about both said sprocket means; and a plurality of longitudinally spaced, transversally extending bars secured at respective ends thereof to said chains.

8. The screening apparatus of claim 7, wherein:

said means for operating said grizzly bar conveyor comprises an hydraulic motor drivingly connected with one of said sprocket means and incorporated in an hydraulic system; and said means for reversing direction of said carrying run of said grizzly bar conveyor comprises means for sensing pressure in said hydraulic system as an indication of resistance to turning of said hydraulic motor.

9. The screening apparatus of claim 2, further including:

a longitudinal conveyor supported on said base and having a carrying run advancing under said drum, for carrying away underflow of material screened by said drum.

10. The screening apparatus of claim 9, further comprising:

a rearwardly inclined slewable conveyor supported on said base and having an inlet end arranged to receive underflow of screened material from said longitudinal conveyor for conveying such underflow away from said apparatus.

11. The screening apparatus of claim 9, further including:

a conveyor arranged to receive and convey away from said apparatus overflow leaving said internal cavity of said drum through said outlet opening means.

12. The screening apparatus of claim 1, wherein:

said means for rotating said drum includes an hydraulic motor incorporated in an hydraulic system; said hydraulic system includes pump means for pressurizing hydraulic fluid in said hydraulic system for turning said hydraulic motor; and said apparatus further comprises an internal combustion engine operatively connected with said pump means for operating said pump means; said engine including a hot exhaust gas outlet pipe including means for diverting hot exhaust gases therefrom into said internal cavity for heating therein material to be screened.

13. The screening apparatus of claim 1, wherein:

said wire means are constituted by multi-stranded steel cables.

14. The screening apparatus of claim 13, wherein:

each said cable makes two said turns circumferentially around said cage structure in opposite directions, so as to have a doubled loop disposed adjacent to opposite ends of said cable.

15. The screening apparatus of claim 14, wherein:

said tensioning means comprise, for each said cable, a respective combined connector and adjustable tensioner secured between a respective said doubled loop and an adjacent said two ends of said cable.

16. The screening apparatus of claim 1, further including:

a shell mounted on said base and at least partially enclosing said drum; and scratcher means externally peripherally provided on said drum and arranged to prevent build up of material on internal surfaces of said shell from interfering with rotation of said drum.

17. The screening apparatus of claim 1, further including:

a frame mounted on said base, and rotary brush means mounted on said frame and arranged to poke into said screening openings from externally of said drum while rotating in engagement with said peripheral wall, for dislodging material clogging said screening openings.

18. The screening apparatus of claim 1, further including:

ground engaging wheels rotatably mounted in said base for providing mobility for said apparatus.

19. A screening apparatus, comprising:

a screening drum including a radially outer peripheral wall having means defining openings therethrough, so that material, while being screened within said drum may pass radially outwards, out of said screening drum through said openings, providing said material is substantially of a given size or smaller;

inlet opening means at one end of said drum for introducing into an internal cavity bounded by said peripheral wall of material to be screened; and outlet opening means at an opposite end of said drum for evacuating an overflow fraction of said material from said drum;

a base;

means for supporting said screening drum so as to extend generally horizontally on said base;

means for rotating said drum relative to said base about the longitudinal axis of said drum;

a feeding conveyor supported on said base and having a carrying run with an outlet end arranged to deliver to said internal cavity of said drum through said inlet opening means a stream of material which is to be screened;

means for driving said feeding conveyor;

control means operatively connected with said means for rotating said drum and with said means for driving said feeding conveyor, for temporarily diminishing delivery to said internal cavity of said drum, of material to be screened, at times when resistance to turning of said drum indicates said drum is already loaded with an excess of material to be screened; and said means for rotating said drum including an hydraulic motor incorporated in an hydraulic system and said control means including means for sensing pressure in said hydraulic system as an indication of resistance to turning of said hydraulic motor.

20. The screening apparatus of claim 19, further comprising:

a prescreening device supported on said base in an overlying relationship to said feeding conveyor for passing an underflow of material thereto; said prescreening device including means for rejecting as overflow, material loaded thereon which is grossly too large to pass through said screening openings of said drum.

21. The screening apparatus of claim 20, wherein:

said means for rejecting as overflow comprises an endless, grizzly bar conveyor, and means for operating said grizzly bar conveyor which includes means for automatically temporarily reversing direction of an upper carrying run of said grizzly bar conveyor at times when resistance to advancing of said grizzly bar conveyor indicates a piece of material has become lodged between bars thereof.

22. The screening apparatus of claim 21, wherein:

said grizzly bar conveyor includes two longitudinally spaced, transversally extending sprocket means; left and right endless chains entrained about both said sprocket means; and a plurality of longitudinally spaced, transversally extending bars secured at respective ends thereof to said chains.

23. The screening apparatus of claim 22, wherein:

said means for operating said grizzly bar conveyor comprises an hydraulic motor drivingly connected with one of said sprocket means and incorporated in an hydraulic system; and said means for reversing direction of said carrying run of said grizzly bar conveyor comprises means for sensing pressure in said hydraulic system as an indication of resistance to turning of said hydraulic motor.

24. The screening apparatus of claim 19, further including:

a longitudinal conveyor supported on said base and having a carrying run advancing under said drum, for carrying away underflow of material screened by said drum.

25. The screening apparatus of claim 24, further comprising:

a rearwardly inclined slewable conveyor supported on said base and having an inlet end arranged to receive underflow of screened material from said longitudinal conveyor for conveying such underflow away from said apparatus.

26. The screening apparatus of claim 24, further including:

a conveyor arranged to receive and convey away from said apparatus overflow leaving said internal cavity of said drum through said outlet opening means.

27. The screening apparatus of claim 19, further including:

a shell mounted on said base and at least partially enclosing said drum; and scratcher means externally peripherally provided on said drum and arranged to prevent build up of material on internal surfaces of said shell from interfering with rotation of said drum.

28. The screening apparatus of claim 19, further including:

a frame mounted on said base, and rotary brush means mounted on said frame and arranged to poke into said screening openings from externally of said drum while rotating in engagement with said peripheral wall, for dislodging material clogging said screening openings.

29. The screening apparatus of claim 19, further including:

ground engaging wheels rotatably mounted in said base for providing mobility for said apparatus.

30. A screening apparatus, comprising:

a screening drum including a radially outer peripheral wall having means defining openings therethrough, so that material, while being screened within said drum may pass radially outwards, out of said screening drum through said openings, providing said material is substantially of a given size or smaller, said radially outer peripheral wall being provided by a circumferentially extending series of longitudinally extending bars spaced from one another circumferentially of said peripheral wall so as to define slots between respective adjacent ones of said bars; at least two axially spaced support rings said bars being mounted to said support rings to provide a cage structure; and a plurality of resilient wire means wrapped circumferentially about said peripheral wall; said wire means being provided as a series of longitudinally spaced turns, defining slots between respective adjacent ones of said turns, superimposed upon said slots between said bars and thereby cooperatively defining with said bars screening openings through said peripheral wall; and means adjustably tensioning said wire means onto said cage structure such as to permit lumps of material while being screened within said drum, when flung through said slots between said bars so as to impact a turn of said wire means, can cause said turn to elastically flex outwardly from said cage sufficiently to temporarily locally increase the effective size of some of said openings, for thereby freeing material clogged into such openings and temporarily permitting passage through such openings of lumps of material which are normally slightly too large to pass therethrough;

inlet opening means at one end of said drum for introducing into an internal cavity bounded by said peripheral wall material to be screened; and outlet opening means at an opposite end of said drum for evacuating an overflow fraction of said material from said drum;

a base;

means for supporting said screening drum so as to extend generally horizontally on said base;

means for rotating said drum relative to said base about the longitudinal axis of said drum;

said means for rotating said drum including an hydraulic motor incorporated in an hydraulic system; said hydraulic system includes pump means for pressurizing hydraulic fluid in said hydraulic system for turning said hydraulic motor; and said apparatus further comprising an internal combustion engine operatively connected with said pump means for operating said pump means; said engine including a hot exhaust gas outlet pipe including means for diverting hot exhaust gases therefrom into said internal cavity for heating therein material to be screened.

31. A screening drum for a screening apparatus, said screening drum comprising:

a radially outer peripheral wall provided by a circumferentially extending series of longitudinally extending bars spaced from one another circumferentially of said peripheral wall so as to define slots between respective adjacent ones of said bars; at least two axially spaced support rings; said bars being mounted to said support rings to provide a cage structure; and a plurality of resilient wire means wrapped circumferentially about said peripheral wall; said wire means being provided as a series of longitudinally spaced turns, defining slots between respective adjacent ones of said turns, superimposed upon said slots between said bars and thereby cooperatively defining with said bars screening openings through said peripheral wall; and means adjustably tensioning said wire means onto said cage structure such as to permit lumps of material while being screened within said drum, when flung through said slots between said bars so as to impact a turn of said wire means, can cause said turn to elastically flex outwardly from said cage sufficiently to temporarily locally increase the effective size of some of said openings, for thereby freeing material clogged into such openings and temporarily permitting passage through such openings of lumps of material which are normally slightly too large to pass therethrough; inlet opening means at one end of said drum for introducing into an internal cavity bounded by said peripheral wall material to be screened; and outlet opening means at an opposite end of said drum for evacuating an overflow fraction of said material from said drum.

32. The screening drum of claim 31, wherein:

said wire means are constituted by multi-stranded steel cables.

33. The screening drum of claim 31, wherein each said cable makes two said turns circumferentially around said cage structure in opposite directions, so as to have a doubled loop disposed adjacent to opposite ends of said cable.

34. The screening drum of claim 32, wherein:

said tensioning means comprise, for each said cable, a respective combined connector and adjustable tensioner secured between a respective said doubled loop and an adjacent said two ends of said cable.

* * * * *